US006226880B1

(12) United States Patent
Pitre

(10) Patent No.: US 6,226,880 B1
(45) Date of Patent: May 8, 2001

(54) QUICK FOCUSING FIREARM SCOPE

(76) Inventor: Rhett Pitre, 2175 W. Laurel, Eunice, LA (US) 70535

( * ) Notice: Subject to any disclaimer, the term of this patent is extended or adjusted under 35 U.S.C. 154(b) by 0 days.

(21) Appl. No.: 09/232,526

(22) Filed: Jan. 18, 1999

(51) Int. Cl.[7] ..... F41G 1/38
(52) U.S. Cl. ..... 33/246
(58) Field of Search ..... 42/106, 101; 33/245, 33/246; 358/257

(56) References Cited

U.S. PATENT DOCUMENTS

| | | | | |
|---|---|---|---|---|
| 4,290,219 | | 9/1981 | Boller et al. | 42/1 |
| 4,309,095 | * | 1/1982 | Buckley | 354/81 |
| 5,020,262 | | 6/1991 | Pena | 42/106 |
| 5,111,587 | * | 5/1992 | Plank | 33/252 |
| 5,180,875 | | 1/1993 | Berry, Jr. et al. | 42/101 |
| 5,181,323 | * | 1/1993 | Cooper | 33/246 |
| 5,276,554 | | 1/1994 | Nassivera | 359/694 |
| 5,521,757 | | 5/1996 | Olson | 359/425 |
| 5,528,847 | | 6/1996 | Fisher et al. | 42/101 |
| 5,625,954 | * | 5/1997 | DePoali | 33/241 |
| 5,924,211 | * | 7/1999 | Wambold, Jr. et al. | 33/246 |

* cited by examiner

*Primary Examiner*—Michael J. Carone
*Assistant Examiner*—Denise J Buckley
(74) *Attorney, Agent, or Firm*—Kenneth L Tolar

(57) ABSTRACT

A quick focusing firearm scope includes an elongated tubular scope housing mounted to the upper surface of the firearm barrel. A focusing gear is provided in place of the conventional rotating focusing ring found on conventional scopes. Mounted adjacent to and engaging the focusing gear is a drive gear having a cable attached thereto. The opposing end of the cable extends through a support member that is mounted to the firearm trigger guard. Pivotally attached to the support member is a trigger member having an arcuate gear attached to the upper end thereof that engages a rotary gear on the cable. The lower end of the trigger member includes a loop that receives a shooter's trigger finger. Accordingly, a shooter may quickly focus the scope by pivoting the trigger member with the index finger.

3 Claims, 2 Drawing Sheets

QUICK FOCUSING FIREARM SCOPE

BACKGROUND OF THE INVENTION

The present invention relates to a firearm scope that may be quickly focused with a shooter's trigger finger.

DESCRIPTION OF THE PRIOR ART

When focusing a rifle scope on an intended target, a shooter must remove his trigger hand from the trigger and rotate a focusing ring on the scope housing while aiming the rifle at the target. Once the scope is in focus, he or she must move the hand back toward the trigger in order to shoot which is inconvenient, cumbersome and time consuming. In addition, certain game may be easily frightened by such movement.

Various focusing assemblies for rifle scopes have been developed in an attempt to overcome this problem. For example, U.S. Pat. No. 5,180,875 issued to Berry, Jr. et. al. relates to a scope adjustment for firearms including a thumb wheel for focusing the scope with the shooter's trigger hand.

U.S. Pat. No. 5,276,554 issued to Nassivera relates to a magnification adjustment system for a variable power rifle scope. The device includes a multi-purpose lever which may be easily manipulated by the thumb of a shooter's trigger hand for adjusting the focus of the scope.

U.S. Pat. No. 5,521,757 issued to Olson relates to an adjustment lever that may be pushed to rotate the adjustment ring.

U.S. Pat. No. 5,528,847 issued to Fisher et al relates to a variable power telescopic sight.

U.S. Pat. No. 5,020,262 issued to Pena relates to a camera mount for rifle scopes whereby the camera is activated when the rifle trigger is pulled.

U.S. Pat. No. 4,290,219 issued to Boller et al relates to a target sight recording apparatus.

As indicated above, various rifle scope adjustment mechanisms have been developed that allow a shooter to focus the scope without removing his or her hand from the trigger. However, the above devices have several disadvantages. The focusing is accomplished with the shooter's thumb. Manipulating the focusing mechanism with one's thumb while maintaining the trigger finger on the trigger is awkward and cumbersome. Furthermore, while focusing with one's thumb, the firearm trigger may be inadvertently pulled. The present invention solves the above described problem associated with conventional firearm scopes by providing a focusing assembly that is manipulated with a trigger member mounted adjacent the firearm trigger. Accordingly, a user may quickly and inconspicuously focus the scope using the trigger finger, without removing the trigger hand from the firearm.

SUMMARY OF THE INVENTION

The present invention relates to a quick focus firearm scope. The device includes a scope attached to the upper surface of a gun barrel having a focusing gear attached to the scope housing. The focusing gear replaces the focusing ring on a conventional rifle scope. The device also includes a mounting bracket attached to the firearm trigger guard. Attached to the mounting bracket is a substantially U-shaped support member having a trigger member pivotally mounted to its lower portion. The trigger member includes a finger receiving loop at a lower end and an arcuate gear member at its upper end. Downwardly depending from the upper portion of the support member is a rotary gear that engages the arcuate gear on the trigger member. The rotary gear is connected to an end of a cable that has a drive gear at its opposing end. The drive gear is mounted to the scope adjacent the focusing gear on the scope housing. Accordingly, the scope may be focused by inserting the trigger finger into the finger loop and pivoting the trigger member in either direction. It is therefore an object of the present invention to provide a firearm scope that may be focused with a shooter's trigger finger.

It is yet another object of the present invention to provide a firearm scope that allows a user to focus a scope without removing the trigger hand from a firing position.

It is yet another object of the present invention to provide a firearm scope that allows a shooter to quickly focus and shoot with minimal movement. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
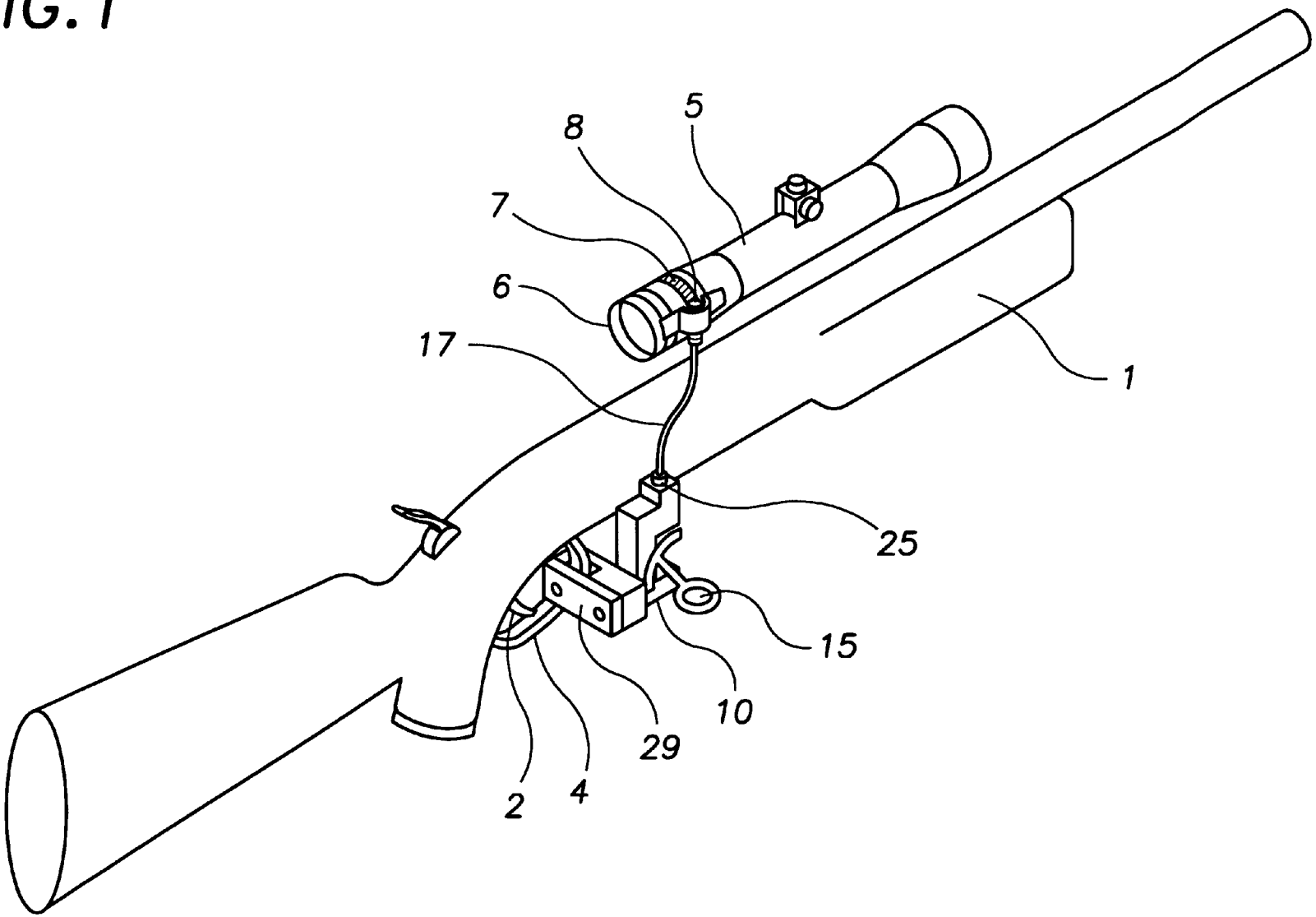
FIG. 1 is a perspective view of the scope according to the present invention mounted on a firearm.
Figure 2:
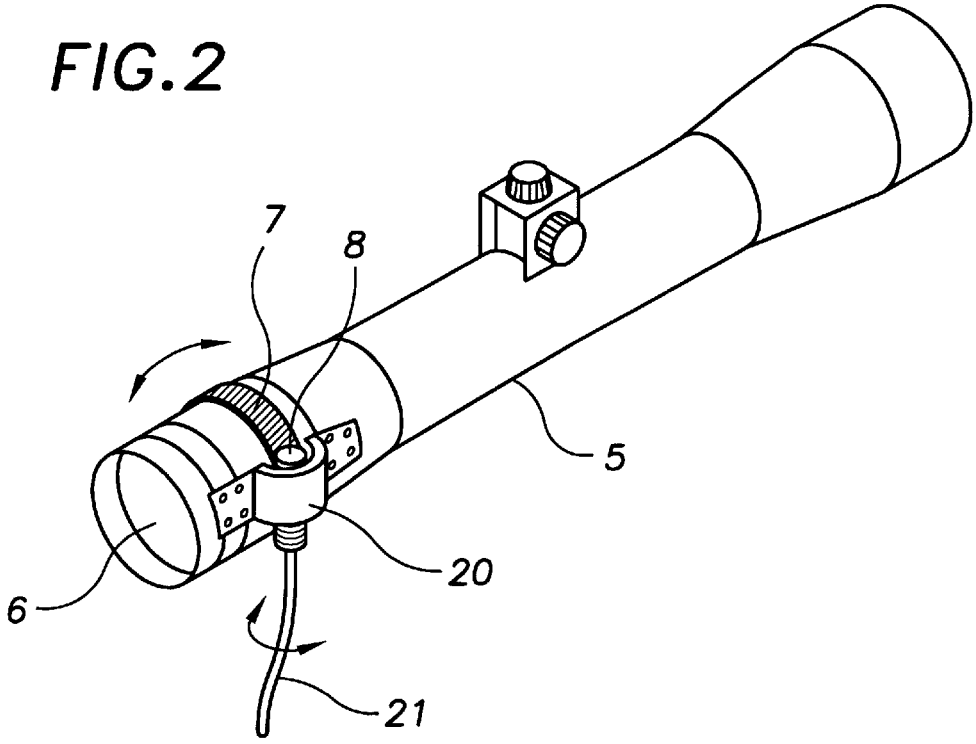
FIG. 2 is a close-up perspective view of the scope according to the present invention.
Figure 3:
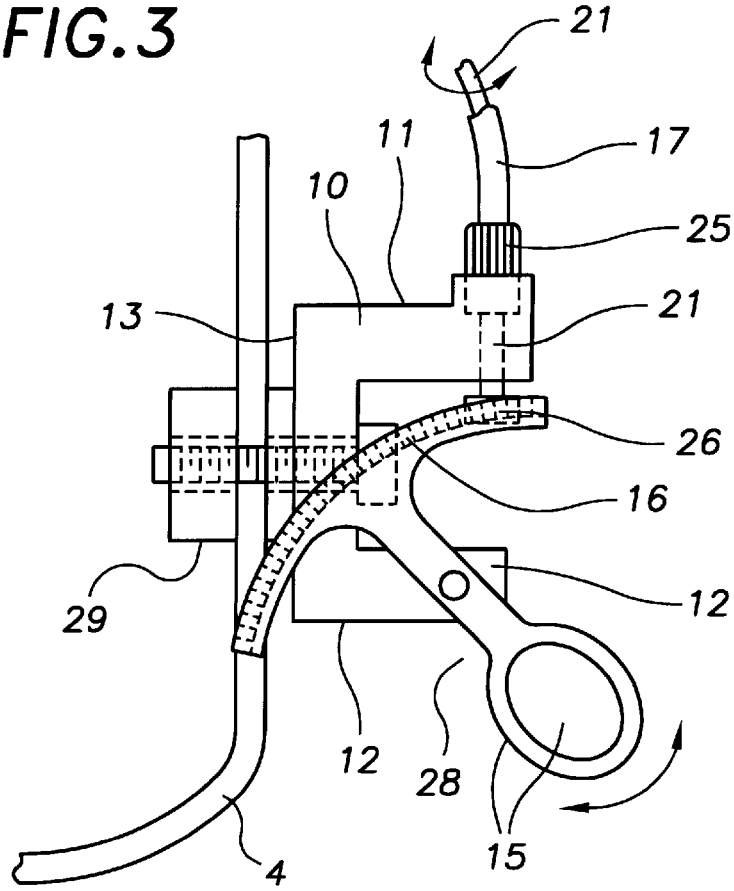
FIG. 3 is a side view of the trigger focusing assembly.

Referring now to FIGS. 1 through 3, the present invention relates to a quick focusing firearm. A conventional firearm such as a rifle 1 includes a trigger 2 for firing the firearm and a trigger guard 4 adjacent thereto. The present invention relates to a scope and focusing mechanism for mounting to the conventional firearm as described above.

The present invention includes a scope resembling a conventional firearm scope including an elongated, substantially tubular housing 5 with an eyepiece 6 at a first end and an opposing open end. Rotatably mounted to the housing proximal the eyepiece is a focusing gear 7 that replaces the focusing ring typically found on a conventional rifle scope. Mounted to the housing and adjacent the focusing gear is a U-shaped clamp member 20 with a drive means received therein for rotating the focusing gear.

The drive means relates to a cylindrical drive gear 8 rotatably mounted within the clamp. The drive gear is attached to the upper end of a cable 21 that rotates the drive gear when manipulated with a trigger mechanism.

The trigger mechanism for rotating the cable and thus the focusing gear includes a bracket member 29 attached to the firearm trigger guard 4. Mounted to the bracket member is a vertically disposed U-shaped support member 10 having an upper portion 11, a lower portion 12 with a vertical portion 13 therebetween. Pivotally attached to the lower portion of the support member is a trigger member 28 having a finger loop 15 at a lower end with an arcuate gear member 16 at its upper end.

The lower end of the cable extends through a bore in the upper portion of the support member. Surrounding the cable is a sheath 17 that allows the cable to freely rotate therewithin. The sheath is secured to the support member with a threaded nut 25 or similar means. Attached to the cable is a rotary gear 26 that downwardly depends from the upper portion of the lower support member. The rotary gear engages the arcuate gear on the trigger member so that pivoting the trigger member causes the rotary gear, the cable and thus the drive gear to rotate in unison. Rotation of the drive gear rotates the focusing gear in a desired direction thereby focusing the scope lens.

To use the above described device, a shooter raises the rifle to the shooting position and peers through the scope eyepiece. To focus the scope on a target, a user simply moves the trigger finger forward slightly and inserts it into the trigger finger loop. The trigger member is then pivoted in either direction until the intended target is clearly in focus. The shooter may then place the trigger finger back on the trigger and fire.

The various components of the above described device are preferably constructed with metal or any suitable equivalent. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A quick focusing assembly for use with a firearm having a trigger for firing the firearm and a trigger guard therearound, said firearm further including a body with a barrel mounted thereon, a quick focusing scope assembly comprising:

an elongated scope housing having an eyepiece at a first end and a second opposing end, said housing mounted to said firearm barrel;

a focusing gear rotatably mounted on said scope housing;

a bracket member mounted to said trigger guard;

a substantially U-shaped support member mounted to said bracket member, said support member having an upper and lower portion;

a drive gear engaging said focusing gear;

a cable having two ends, with a first end attached to said drive gear, and a second end extending through the upper portion of said support member;

a rotary gear attached to the second end of said cable;

a trigger guard member pivotally mounted to the lower portion of said support member, said trigger guard member having an upper end with an elongated gear attached thereto, said elongated gear engaging said rotary gear, said trigger member further having a lower end with a finger receiving loop extending therefrom.

2. A quick focusing assembly for use with a firearm, said firearm having a trigger for firing the firearm and a trigger guard therearound, said firearm further including a body with a barrel mounted thereon, a quick focusing scope assembly comprising:

an elongated scope housing having an eyepiece at a first end and a second opposing end, said housing mounted to said firearm barrel;

a focusing gear rotatably mounted on said scope housing;

a trigger guard member pivotally mounted to said trigger guard, said trigger guard member having a finger loop at a lower end and a gear at an opposing upper end;

a cable having a first end with a rotary gear attached thereto, said rotary gear engaging said gear on said trigger guard member, said cable further including an opposing second end;

a drive gear attached to the opposing second end of said cable, said drive gear mounted adjacent said scope housing and engaging said focusing gear whereby pivoting said trigger member causes said cable, said drive gear and said focusing gear to rotate in unison.

3. The device according to claim 2 further comprising a sheath surrounding said cable in which said cable freely rotates.

* * * * *